US007703873B2

(12) United States Patent
Liu et al.

(10) Patent No.: US 7,703,873 B2
(45) Date of Patent: Apr. 27, 2010

(54) METHOD AND APPARATUS FOR IMAGE REGISTRATION

(75) Inventors: Hsue-Yang Liu, Vancouver, WA (US); Jan Elizabeth Casey, Vancouver, WA (US); Weiyun Sun, Vancouver, WA (US); Thieu X. Dang, Vancouver, WA (US); Edward L. Feldhousen, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 477 days.

(21) Appl. No.: 11/724,948

(22) Filed: Mar. 15, 2007

(65) Prior Publication Data

US 2008/0225065 A1 Sep. 18, 2008

(51) Int. Cl.
*B41J 29/38* (2006.01)

(52) U.S. Cl. ..... 347/14; 347/8; 347/19

(58) Field of Classification Search ..... 347/8, 347/14, 16, 19, 37

See application file for complete search history.

(56) References Cited

U.S. PATENT DOCUMENTS

| | | | | |
|---|---|---|---|---|
| 6,603,574 | B1 | 8/2003 | Ramirez et al. | |
| 7,434,904 | B2 * | 10/2008 | Tanaka et al. | 347/14 |
| 2007/0165059 | A1 * | 7/2007 | Nishizaka | 347/19 |

* cited by examiner

*Primary Examiner*—Thinh H Nguyen

(57) ABSTRACT

A method of registering an image onto a sheet of media on an imaging surface of a printer having a printhead for imaging onto the sheet, comprising: detecting a position of said sheet of media being advanced onto the imaging surface using a first sensor positioned along said media path upstream of the printhead; and firing the printhead at a time based on the detected position and a calibrated distance between the sensor and the printhead.

17 Claims, 7 Drawing Sheets

METHOD AND APPARATUS FOR IMAGE REGISTRATION

FIELD OF THE INVENTION

The invention relates generally to handling sheets of media through a printing apparatus and more particularly to registering an image onto media of the printing apparatus.

BACKGROUND OF THE INVENTION

A media handling subsystem transports a media sheet through a printing apparatus, such as a computer printer, fax machine or copy machine, for imaging. A media sheet is picked from a stack, typically in a tray, then moved along a media path using drive rollers. Along the media path, the media sheet is positioned relative to an imaging mechanism, such as an ink or toner cartridge or printhead, which forms character and/or graphic markings on the media sheet.

For drum based printers, for example, a sheet is fed to the rotating drum by a sheet feeder, and a vacuum captures it and rolls it on to the drum. In scanning-carriage printing systems, such as inkjet printers for example, printheads are typically mounted on a carriage that is moved back and forth across the print media. As the printheads are moved across the print media, the printheads are activated to deposit or eject ink droplets onto the print media to form text and images. The print media is generally held substantially stationary while the printheads complete a "print swath", typically an inch or less in height; the print media is then advanced between print swaths. The need to complete numerous carriage passes back and forth across a page has meant that such printers have typically been significantly slower than some other forms of printers, such as laser printers, which can essentially produce a page-wide image.

The ink ejection mechanisms of inkjet printheads are typically manufactured in a manner similar to the manufacture of semiconductor integrated circuits. The print swath for a printhead is thus typically limited by the difficulty in producing very large semiconductor chips or "die". Consequently, to produce printheads with wider print swaths, other approaches are used, such as configuring multiple printhead dies in a printhead module, such as a "page wide array". Print swaths spanning an entire page width, or a substantial portion of a page width, can allow inkjet printers to better compete with laser printers in print speed.

One type of printing system utilizes multiple printhead modules that each print a substantial portion of a page width; the modules are on carriages that need to be accurately positioned such that visible print defects are not introduced where the separately-printed portions of the page meet.

In order to ensure accurate media or image registration of the printing system, the print engine needs to correlate reference coordinates in both the drum spin or media advance direction (e.g. X-direction) as well as in the carriage motion direction (e.g. Y-direction). Such reference coordination is needed to register the media according to required print margins (e.g. 2 millimeter (mm) print margin). Furthermore, the print engine needs to know where the media is loaded onto the drum relative to the carriages so as to know where to move the carriages and when to trigger the start of printing.

SUMMARY OF THE INVENTION

In a basic form a method of calibrating image registration onto a sheet of media of a printer comprises: determining a first relative distance between a first sensor for sensing advancement of a sheet of media onto an imaging surface and a printhead of a carriage along a first axis, by performing measurements on the printer; determining a second relative distance between a second sensor movable along a second axis and the printhead by performing measurements on the printer; determining a third relative distance between the first and second sensors by performing measurements on the printer; and adjusting imaging of a sheet of media advanced onto an imaging surface of the printer and sensed by the first sensor using the first, second and third relative distances.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts and.

DETAILED DESCRIPTION OF THE PREFERRED EMBODIMENTS

The following description of the preferred embodiments is merely by way of example and is in no way intended to limit the invention, its application, or uses.

Figure 1:
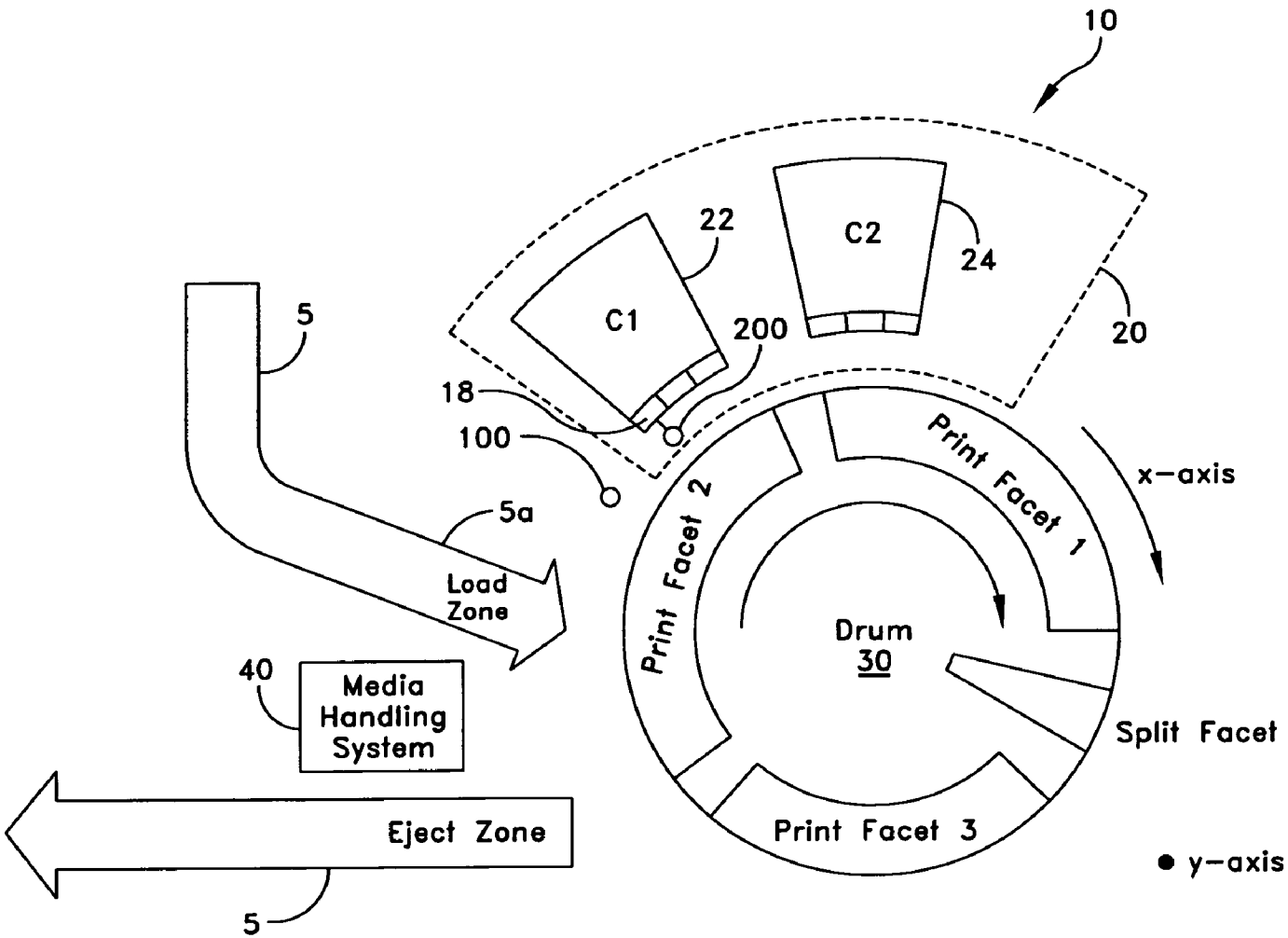
FIG. 1 is a schematic front view of a media path and printing apparatus suitable for implementing an embodiment of the present invention.

FIG. 1 shows a simplified schematic view of a media path 5 through a printing apparatus 10 according to an embodiment of this invention. Apparatus 10 may take the form of a printer suitable for use with one or more computing devices, a copier, a facsimile machine or a multi-function printing apparatus that incorporates printing/copying/faxing functionalities, all by way of non-limiting example.

Apparatus 10 includes an imaging mechanism 20 for printing images on media sheets while they are supported by drum 30. The media sheets may take the form of sheets of paper, transparencies or any other substrate suitable for having images printed thereon. Mechanism 20 may take the form of a monochrome and/or color printing mechanism, and incorporate one or more print cartridges (such as cartridges that incorporate ink or toner) and/or one or more print carriages 22, 24 that carry one or more printheads or print nozzles, such as ink-jet pen print bodies, all by way of non-limiting example only. Printheads 18 comprise printheads configured to dispense imaging material, such as ink, upon the medium held by drum 30. In one embodiment, printheads 18 comprise piezo electric printheads. In another embodiment, printheads 18 comprise thermal inkjet printheads. As shown by FIG. 1, printheads 18 may be arranged in essentially linear fashion and configured to print across a large area of the media supported by drum 30. In the illustrated embodiment, the imaging mechanism 20 includes two carriages 22, 24 each containing a predetermined number of printheads (e.g. three). Drum 30 rotates and transports media sheets past the movable carriages.

According to an embodiment of the present invention, drum 30 may be suitable for advancing media sheets of different sizes past imaging mechanism 20 in different modes. In such a case, drum 30 may be configured to have a different number of media sheet imaging facets in the different modes. As shown in FIG. 1, drum 30 includes three imaging or printing facets, and is well suited for use where three media sheets may be simultaneously engaged by drum 30. Of course, other drum configurations and numbers of facets may be used. FIG. 1 further illustrates the drum location for a spit facet useful for firing printheads to a spittoon assembly (not shown) in order to maintain ink ejection quality.

Apparatus 10 includes a media handling system 40 that transports media sheets along path 5 to drum 30, and in the illustrated embodiment, receives media sheets from drum 30. The media handling system includes a plurality of drive rollers (not shown), each akin to an elastomeric "tire". The driver rollers are typically grouped about a rotating shaft (not shown). Each shaft is typically driven by a motor responsively to a media transport controller.

The media handling system picks media sheets from stacks of one or more media sheets supported by input trays. Media sheets picked from the trays are fed along media path 5 through the print apparatus 10 to receive printed markings by imaging mechanism 20.

Figure 3:
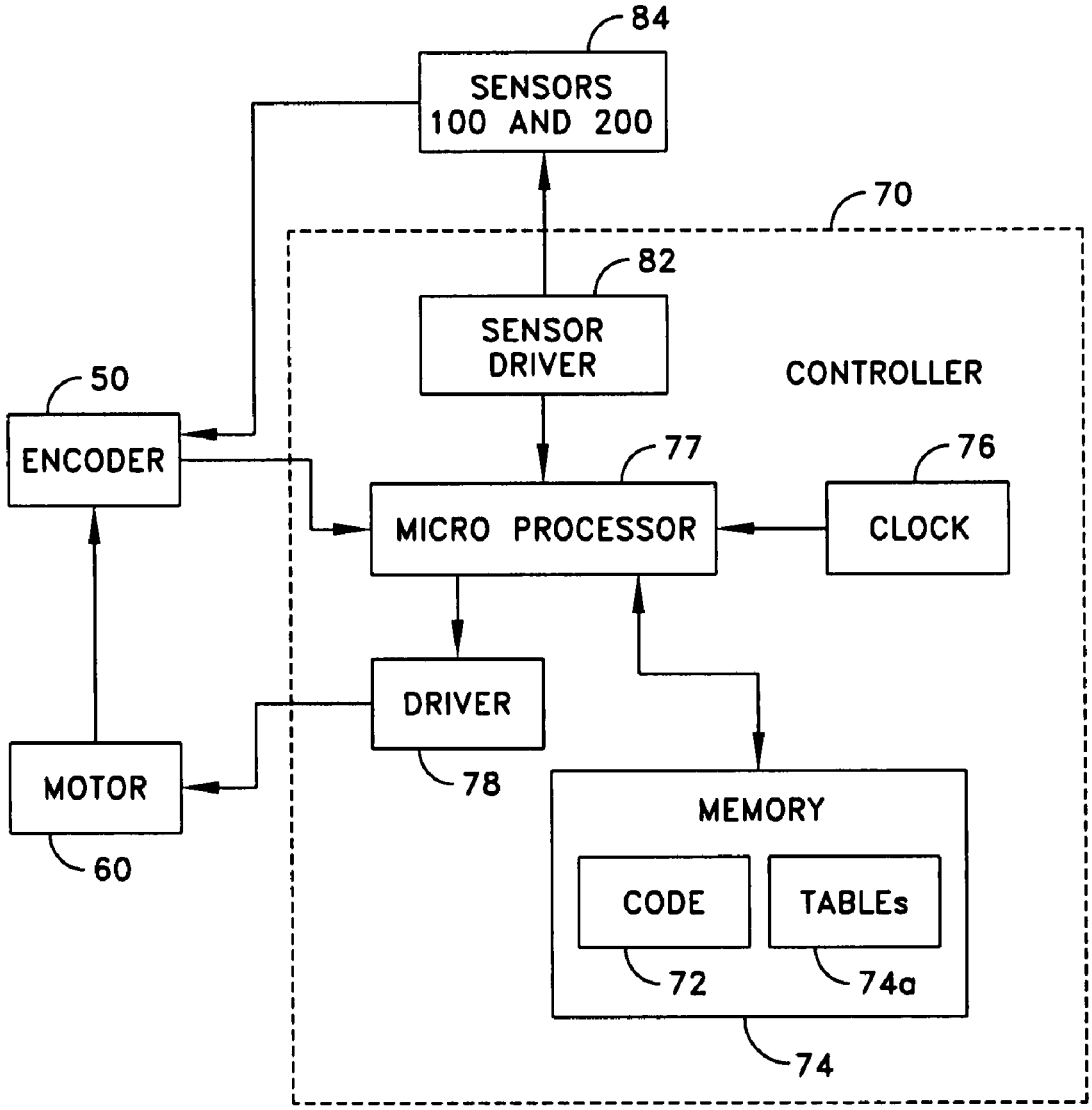
FIG. 3 is a block diagram of a printer controller and associated components for which the present invention may be adapted.

Referring now to FIG. 3 in conjunction with FIG. 1, a rotary encoder 50 is operably coupled to rotatable drum 30 by for example, a shaft that couples drum 30 to a drum motor 60. For non-limiting purposes of explanation only, a rotary encoder may typically take the form of an electro-mechanical and/or opto-mechanical device used to convert the angular position of a shaft or axle to a digital code. Rotary encoder 50 may take the form of a conventional rotary encoder suitable for providing a signal indicative of the position of drum 30. Controller 70 is adapted to drive drum motor 60 and to read position values from encoder 50 corresponding to the position of drum 30. Rotary encoder 50 may have a position encoding resolution sufficient to allow encoder 50 to provide position indication on the order of $1/7200^{th}$ inch of drum rotational travel. For example, rotary encoder 50 may have a physical resolution on the order of about $1/150^{th}$ inch or about $1/300^{th}$ inch.

Still referring to FIG. 3, controller 70 may typically take the form of a computing device that includes a processor. A processor generally includes a Central Processing Unit (CPU), such as a microprocessor. A CPU generally includes an arithmetic logic unit (ALU), which performs arithmetic and logical operations, and a control unit, which extracts instructions (e.g., code 72) from memory and decodes and executes them, calling on the ALU when necessary. "Memory", as used herein, generally refers to one or more devices capable of storing data, such as in the form of chips, tapes, disks or drives. Memory may take the form of one or more random-access memory (RAM), read-only memory (ROM), programmable read-only memory (PROM), erasable programmable read-only memory (EPROM), or electrically erasable programmable read-only memory (EEPROM) chips, by way of further example only. Memory may take the form of internal or external disc drives, for example. Memory may be internal or external to an integrated unit including a processor. Memory preferably stores a computer program or code, e.g., a sequence of instructions being operable by a processor. Controller 70 may take the form of hardware, such as an Application Specific Integrated Circuit (ASIC) and or firmware, in addition or in lieu of incorporating a processor.

FIG. 3 shows an exemplary block diagram of controller 70. As seen controller 70 includes a multipurpose microprocessor 77, which, for the purposes of simplicity, is described here in connection with controlling motion of the drum and carriage position. That processor includes associated memory 74 that is pre-programmed to carry out the method of the present invention as explained below. The printer controller 70 is provided with conventional clocking components 76 with which, among other things, operates to correlate printer activities with drum rotation. For example, when a printing task is undertaken and, in particular, when print media needs to be advanced or when carriage movement or positioning is required, the microprocessor provides via motor driver 78 signals that are suitable for driving the corresponding motor. In this regard, the signals may be in the form of a drive voltage placed across the input terminals of the motor. The resulting current rotates the motor shaft and connected gears and positioning assemblies.

In an exemplary embodiment, memory 74 contains or stores at least one table 74*a* having data entries. According to an embodiment of the present invention, each data entry is indicative of a drum 30 position and at least one associated action, or event. At least some of the actions or events have associated subroutines that may be executed by or at the request of the controller upon occurrence or detection thereof. Such actions, for example, include printhead firing, paper positioning, carriage positioning, and the like. Processor 77 further operates to control sensors 100 and 200 (FIG. 1) illustrated by block 84 via corresponding sensor drivers 82. Table 74*a* may include a separate table for each printing mode, e.g., for different sized media and/or color/monochrome. The microprocessor is apprised by the printer firmware (memory 74) of drum position and motor motion (which is correlated to the various paper advance distance) is monitored by microprocessor 77 via analog, rotary encoder 50 that is associated with the rotating drive shaft of the motor. Suitably conditioned feedback signals are provided to the microprocessor 77 so that, in conjunction with the system clock information, the microprocessor can instantaneously calculate relative positions and adjust print activities in response thereto.

Figure 2:
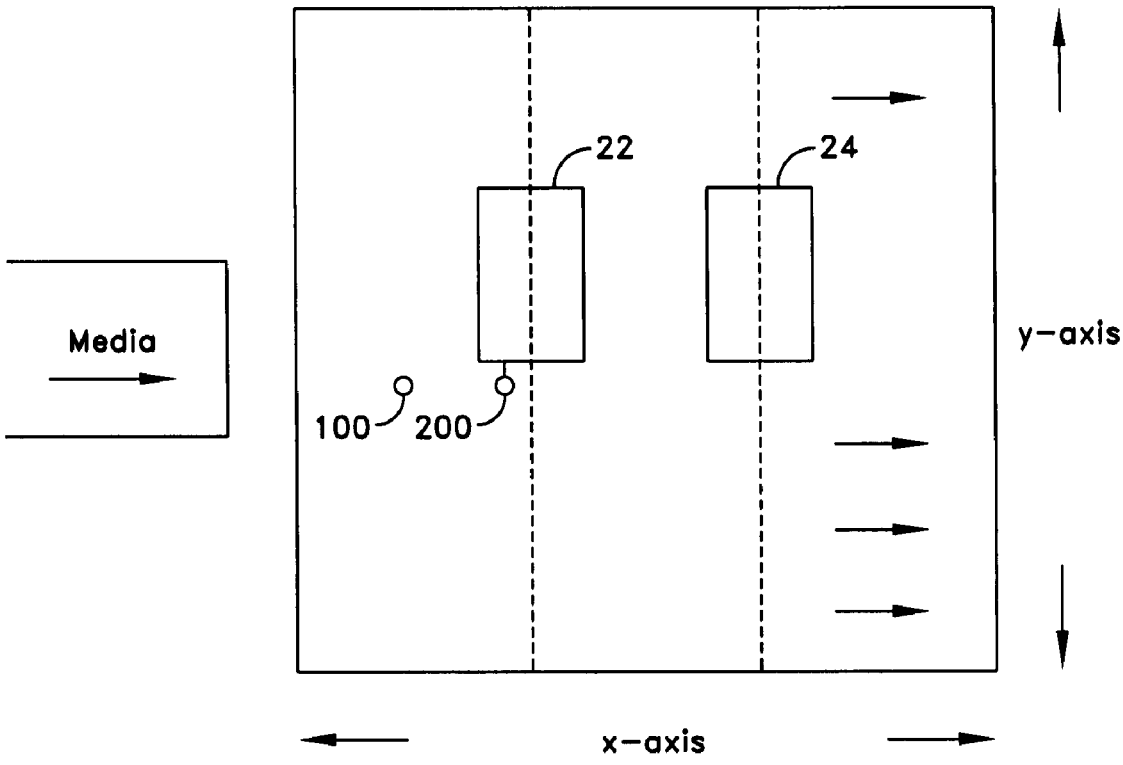
FIG. 2 is a schematic top view of the media path and printing apparatus of FIG. 1.

Referring again to FIG. 1 in conjunction with FIG. 2, and in accordance with an exemplary embodiment, apparatus 10 further includes a first sensor 100 disposed between a load zone or staging location 5*a* and the carriages 22, 24 and along the media path 5 in the direction of media advancement (X-axis). First sensor 100 is upstream of the printhead and may operate in conjunction with controller 70. In one configuration, first sensor 100 is fixedly positioned between the drum 30 and the load zone or staging area with at least one roller activated by a corresponding motor.

According to an embodiment of the present invention, sensor 100 may take the form of an optical sensor. Accordingly, sensor 100 may incorporate a light source and a light detector. Exemplary light sources include a photo-emitter, LED, laser diode, super luminescent diode and fiber optic source. Exemplary light detectors include a photo-detector, charged couple device and photodiode. The light source is oriented to emit a light beam onto drum 30. The light detector is aligned to detect light emitted from the source, either directly or after being reflected by the media, for example. Other types of detectors, such as one or more flag sensors, may be used as sensor 100.

As further shown in FIG. 1 in conjunction with FIG. 2, a second sensor 200 is provided. Sensor 200 is moveable and in one configuration, operatively coupled to carriage 22 so as to be movable along the carriage axis or Y-axis. Sensor 200 may take the form of an optical sensor. Accordingly, sensor 200 may incorporate a light source and a light detector. Exemplary light sources include a photo-emitter, LED, laser diode, super luminescent diode and fiber optic source. Exemplary light detectors include a photo-detector, charged couple device and photodiode. The light source is oriented to emit a light beam onto drum 30. The light detector is aligned to detect light emitted from the source, either directly or after being reflected by the media, for example. Other types of detectors, such as one or more flag sensors, may be used as sensor 200.

For purposes of explanation only, the illustrated embodiment of FIG. 2 provides carriages 22, 24 moveable along the Y-axis. The printheads 18 contained in movable carriages 22, 24 are therefore also movable along the Y-axis. Drum 30 is shown to rotate around the Y-axis. Controller 70 is configured to control firing position of the printheads according to the expected media position based on rotation position of the drum.

In an exemplary embodiment, and still referring to FIGS. 1 and 2, the printheads 18 when printing on the media, print in the X-axis. As no absolute physical reference coordinate system exists in both X and Y axes and as the print controller requires knowledge as to where the media is loaded onto the drum, a calibration method is implemented to accurately register images onto media on a drum in the X and Y directions using the moveable sensor to correlate the media position for accurate image placement. In one configuration, for the X direction, first sensor 100 is used to measure the position of the leading edge of the media. The measured position is used to control when the printheads are to be fired. For the Y direction the moveable sensor 200 is used to measure the long edge or side edge of the media. This measured position is used to control the position of the carriages 22, 24 as the image is printed. In order to provide enhanced accuracy calibration operations include determination of relative distances between the first and second sensors and the printheads 18. These distance determinations may be stored in memory and used to dynamically adjust print firing position as media is applied to the drum for printing.

Figure 4:
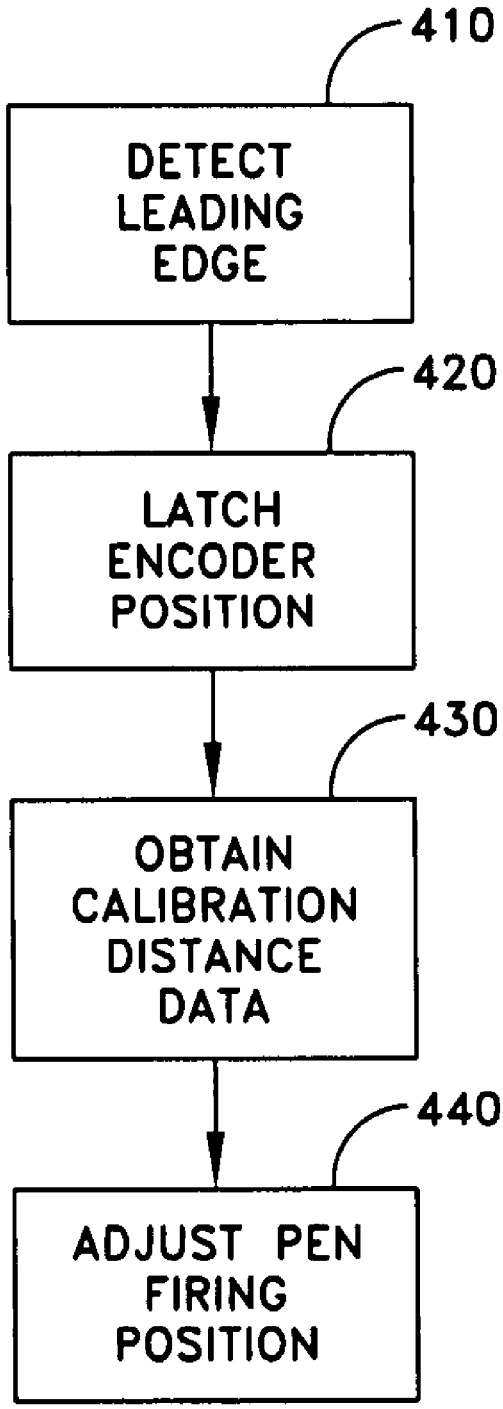
FIG. 4 is a flow diagram of a process for dynamically adjusting print head firing position according to an embodiment of the present invention.

Referring now to the simplified flow diagram of FIG. 4, in conjunction with FIGS. 1 and 2, there are provided operations for registering an image onto a sheet of media according to an embodiment of the present invention. As a sheet of media to be printed is being applied to the rotating drum 30, first sensor 100 positioned between the drum and the loading zone operates to detect advancement of the sheet of media onto the drum (block 410).

In one configuration, the first sensor 100 performs leading edge detection of the advancing media sheet in the X-direction. In response to the edge detection the encoder position associated with the drum is latched and reported to controller 70 (block 420) using corresponding electronics (not shown). Controller 70 includes in its table in memory 74 the encoded drum positions for firing the printheads 18 for imaging the media. According to an aspect of the present invention, controller 70 retrieves calibrated distance data (e.g. previously stored relative distance data) corresponding to the relative measured distance between the first sensor 100 and the printheads in the X-direction (block 430) and adjusts the firing position at which the printheads are to fire onto the media based on the detected encoded position of the media engaging the drum and the retrieved distance between the first sensor and the printhead (block 440).

For example, controller 70 has a given pen or printhead (e.g. printhead 1) scheduled to fire at a given drum encoder position such as position 10,300. The relative distance D1 in encoder position units between the first sensor 100 and printhead 1 is calibrated beforehand (e.g. off-line) and stored. By knowing D1 (e.g. 300 encoder units) and further knowing the distance from the first sensor to the drum (e.g. assume 2 encoder units), controller 70 thus expects first sensor 100 to detect the media sheet at (10,300)−(300)−(2)=9,998. If, however, the first sensor 100 detects the media at latched encoder position 9,970 (indicating the media is being applied to the drum earlier than scheduled), the controller 70 operates to recalculate when the first printhead should start firing using the detected information and calibration data, to correctly place the image in the X-direction. In this example, the printhead 1 firing position would be adjusted to (9,970)+(300)+(2)=10,272 encoder drum position.

For purposes of discussion, it is understood that the measured distance from the first sensor to printhead 1 is an ideal logical, such that all printheads are aligned and relative offsets are obtained for corresponding printheads. In similar fashion, it is understood that the offset distance between the first sensor and the drum is known or compensated for as part of the edge detection encoder latching or controller readout.

Figure 5:
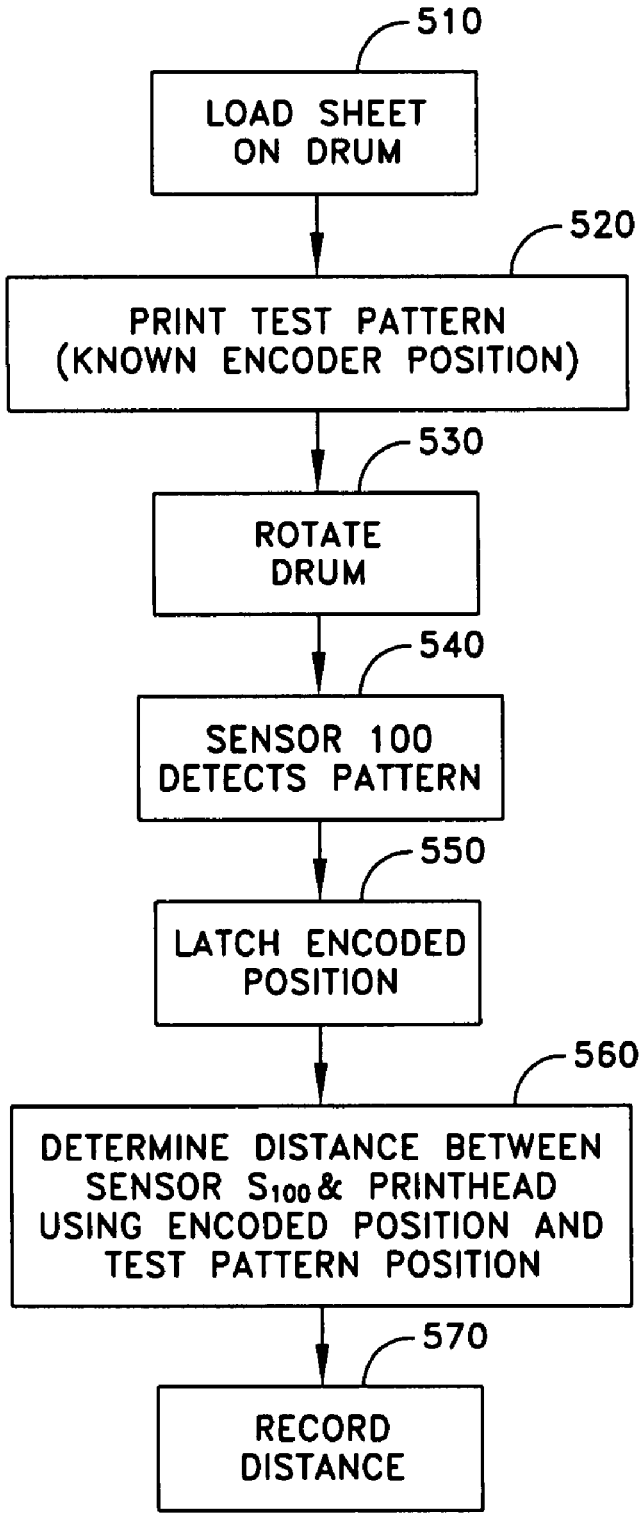
FIG. 5 is a flow diagram of a process for determining distances between a sensor and a print head according to an embodiment of the present invention.

In any event, X registration calibration by measuring the distance between the first sensor 100 and a given printhead (e.g. the first printhead) is performed statically (e.g. offline) and the value stored in memory. FIG. 5 shows a simplified flow diagram for determining the relative distance between the first sensor 100 and a print nozzle or printhead 18 of carriage 22. A media sheet is loaded onto drum 30 at block 510. A test pattern is then printed onto the media sheet in the vertical location (block 520). The controller knows the encoder position (e.g. EP A) of the drum at which the printhead was fired for generating the test pattern. The pattern is printed at a location on the media such that the pattern may be seen by first sensor 100 as the drum 30 rotates (block 530). During drum rotation, first sensor 100 detects the pattern (block 540) and in response to the detection, generates a signal to cause the encoder to latch the corresponding rotary position (e.g. EP B). The encoder position is recorded (block 550). The relative distance D1 in the X-direction between the first sensor 100 and the printhead is calculated (block 560) by subtracting the encoded position (EP A) of where the printhead printed the test pattern from the recorded detected encoder position (EP B). The calibrated relative distance D1 is then stored (block 570) for later use when printing media sheets as described above.

Figure 6:
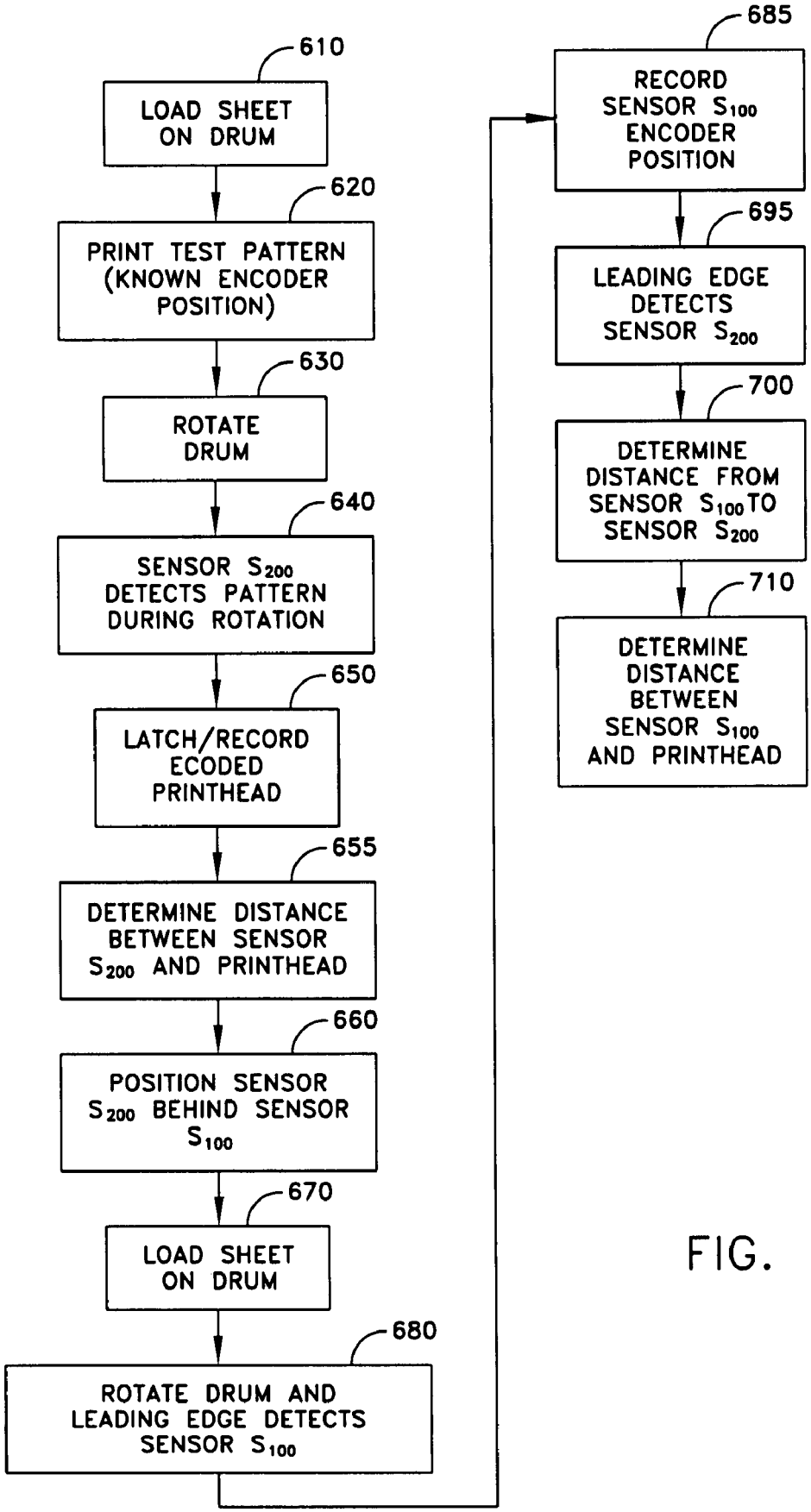
FIG. 6 is a flow diagram of a process for determining media registration along the X axis according to an embodiment of the present invention.

Referring now to the flow diagram of FIG. 6, in another configuration the distance between the first sensor 100 and a print nozzle or printhead of carriage 22 is calculated using second sensor 200. This calibration method may be used, for example, when sensor 100 is incapable of performing pattern detection, but performs edge detection. This may be accomplished by loading a sheet of media on the drum (block 610) and printing a test pattern on the sheet of media (block 620). The controller knows the encoder position (e.g. EP A) of the drum at which the printhead was fired for generating the test pattern. Moveable sensor 200 is positioned to enable sensor 200 to see the printed pattern (block 625). This may be accomplished, for example, by moving the carriage 22 to which sensor 200 is operably coupled, so as to position the sensor to see the printed pattern. The drum is then rotated (block 630). During drum rotation, second sensor 200 detects the pattern (block 640) and in response to the detection, generates a signal to cause the encoder to latch the corresponding rotary position (e.g. EP C). The encoder position is recorded (block 650). The relative distance D2 in the X-direction between the second sensor 200 and the printhead is calculated (655) by subtracting the encoded position (EP A) of where the printhead printed the test pattern from the recorded detected encoder position (EP C). The calibrated relative distance D2 is then stored for later use.

Operation continues by positioning the movable second sensor 200 to be at the same vertical position as the first sensor 100, which is stationary (block 660). This may be accomplished by again moving the carriage 22 with which sensor 200 is coupled so as to properly position second sensor 200 to be in vertical alignment with first sensor 100. A sheet of media is loaded onto the drum (block 670) and a leading edge of the sheet media is detected (block 680) by first sensor 100 as the sheet advances to the drum. The encoded position associated with the detection is latched/recorded (block 685) (e.g. EP D). The leading edge of the sheet media is also detected (block 690) by the second sensor 200 as the sheet continues to advances about the drum. The encoded position associated with this detection is also latched/recorded (block 695) (e.g. EP F).

The relative distance D3 from the first sensor 100 to second sensor 200 is then calculated (block 700) using D3=(EP D)−(EP F) based on the corresponding recorded encoder positions (block 685, 695). The relative distance D4 from the first sensor 100 to the print head 18 is then calculated (block 710) by adding the magnitudes of the relative distances D2 and D3 from block 655 and block 700.

Figure 7:
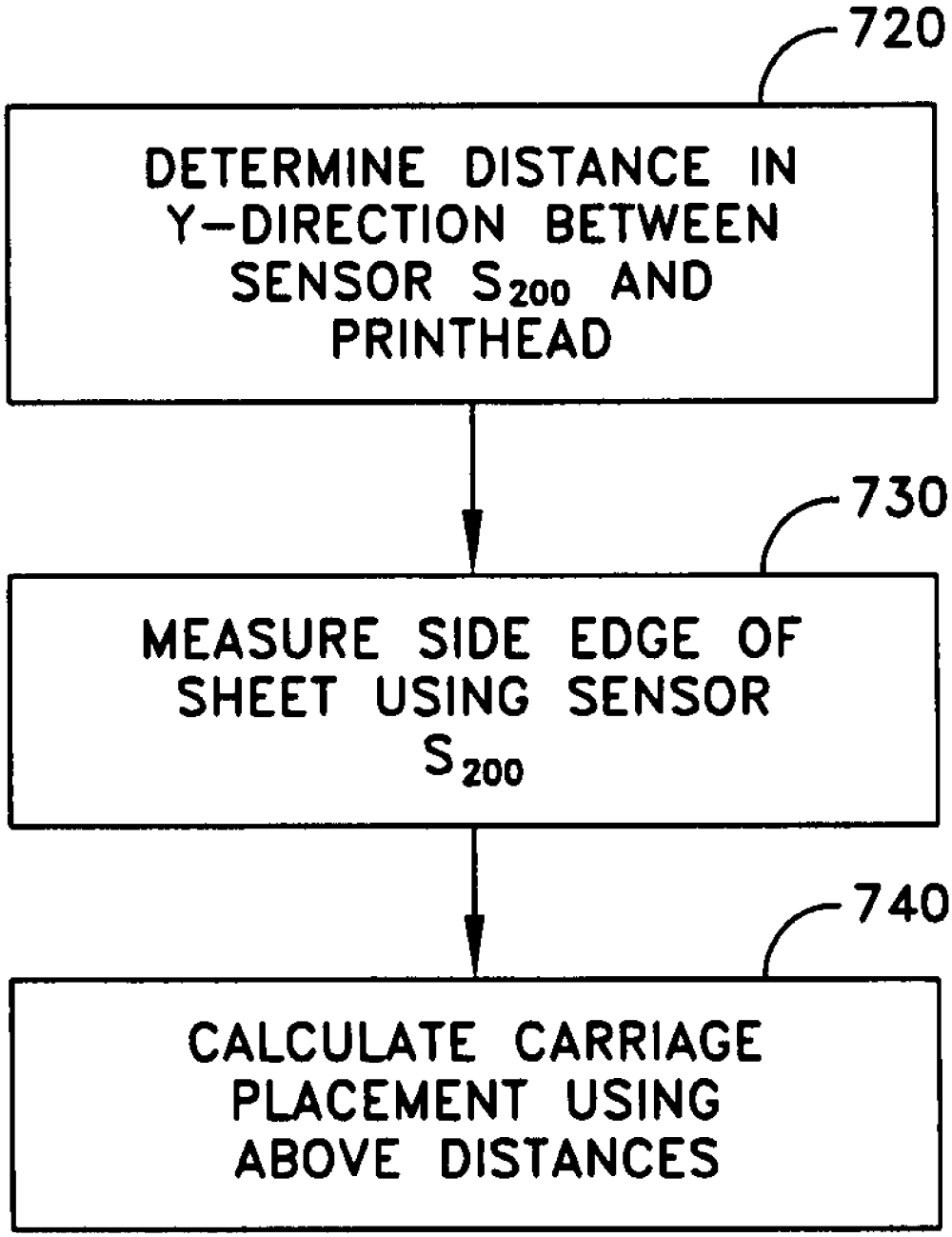
FIG. 7 is a flow diagram of a process for determining media registration along the Y axis according to an embodiment of the present invention.

In accordance with another aspect of the present invention, registration in the Y-direction may be performed in accordance with the flow diagram of FIG. 7. In general, Y-registration proceeds by calibrating by measuring the distance between the second sensor and the printhead; calibrating by measuring the paper side edge position; and for each page after the aforementioned calibration steps are completed, using the calibrated measured distances to calculate where to place the cartridges for printing each subsequent page. Operations commence by measuring the distance between the second sensor 200 and the first printhead 18 in the Y-direction (block 720). The resulting distance is stored in memory. In one embodiment, this distance may be calculated by loading a sheet onto the drum and printing a target to determine vertical offset. This may be a horizontal black bar. The drum is then stopped so that the second sensor 200 axis will cross over the target. Sensor 200 is then positioned for scanning across the target by moving the carriage to the middle of the drum. Processing proceeds with scanning with sensor 200 by moving the carriage across the target. As the carriage moves, sensor 200 readings will be made and stored into a memory buffer. The buffer is analyzed to find the center of the target. This represents the centroid analysis. The purpose is to find the position of the target using the scanned data. Alternatively, edge detection may also be used. The distance between sensor 200 and the printhead is then calculated: Carriage position when the target is printed and the printhead position within the carriage; carriage position at the start of the scan determines the position of the first datapoint in the scan; location of the calculated centroid in the scan buffer.

As shown in block 730 the second sensor 200 then measures the side edge of the sheet media. This is accomplished by scanning the carriage such that the carriage is slewed off sheet and the sensor cannot see the media and then slewing the carriage until the side edge of the media sheet is detected. For each page, the measured distance between sensor 200 and the first printhead and the sensor measured paper side edge position is used to calculate where to place the carriages for printing operations.

In one embodiment, this distance may be calculated by loading a sheet onto the drum and printing a test pattern onto the sheet. Once the test pattern is applied to the sheet of media, rotate the drum a predetermined amount and stop the drum at a position such that the second sensor 200 can detect the pattern as the carriage is moved along the Y-axis. In one configuration, the carriage is slewed to a rearward position and then moved until sensor 200 detects the pattern along the side edge of the media sheet. At this point the difference between where the pattern was detected by the second sensor and where the carriage printhead printed the pattern is determined and carriage placement determined (block 740).

The calibration system and method of the present invention enables an image to be accurately printed on a sheet of media in the presence of unit to unit variance in physical distances between sensors and carriages as well as variance in the load position of each page. Furthermore, the calibration process can be implemented as part of automatic pen alignment (APA) activities without impacting the overall time for pen alignment processing. Still further, the prestored process for X-Y calibration may be utilized as part of field service processes to re-calibrate media registration after parts (such as sensor 100, sensor 200, carriage or drum encoder devices, for example) have been repaired or replaced.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of registering an image onto a sheet of media on an imaging surface of a printer having a printhead for imaging onto said sheet, comprising:

detecting a position of said sheet of media being advanced onto said imaging surface using a first sensor positioned along said media path upstream of said printhead; and using a digital controller for firing said printhead at a time based on the position of said sheet of media detected by the first sensor and a predefined calibrated distance between said sensor and said printhead.

2. Apparatus for registering an image onto a sheet of media on an imaging surface of a printer having a printhead for imaging onto said sheet, comprising:

a first sensor positioned along a media path upstream of said printhead and adapted to detect advancement of said sheet of media onto said imaging surface;

memory containing data corresponding to a predefined measured distance between said first sensor and said printhead; and a controller for adjusting firing of said printhead based on said detected position of said sheet of media and said measured distance.

3. A method of calibrating image registration onto a sheet of media applied to a printer comprising:

using a digital controller for determining a first relative distance between a first sensor for sensing advancement of a sheet of media onto an imaging surface and a printhead of a carriage along a first axis using measurements performed on said printer;

using the digital controller for determining a second relative distance between a second sensor movable along a second axis of the printer and the printhead using measurements performed on said printer;

using the digital controller for determining a third relative distance between said first and second sensors by using measurements performed on said printer; and storing said first, second and third relative distances in computer readable memory of the printer for use in automatically adjusting a sheet of media advanced onto an imaging surface of said printer and sensed by said first sensor using said first, second and third relative distances.

4. The method of claim 3, further comprising determining an expected edge position of a sheet of media along the second axis when said sheet is loaded onto a printer drum of the printer by performing measurements on said printer.

5. The method of claim 3, wherein each of said determining steps is performed when said printer is in a calibration mode.

6. The method of claim 3, wherein when a particular sheet of media is to be printed upon, said imaging of said particular sheet is adjusted along at least one of said first and second axes using said first, second and third relative distances.

7. The method of claim 3, wherein said printer includes a rotatable drum, and wherein said first axis is in the direction of the sheets of media advancing onto said drum.

8. The method of claim 3, wherein said second axis of the printer is in the direction of carriage motion.

9. The method of claim 8, wherein said first and second axes are orthogonal.

10. The method of claim 3, wherein said first relative distance is determined using the determined distance between the second sensor and the printhead, and the determined distance between the first sensor and the second sensor.

11. A method of calibrating image registration onto a sheet of media in a printer having a drum rotatable along a first axis, and a carriage movable along a second axis about which said drum rotates, comprising:

using a digital controller for determining a first relative distance between a first sensor and a printhead of the carriage, the first sensor disposed between a loading stage of a media path and the drum;

using the digital controller for determining a second relative distance between a second sensor movable along the second axis and the printhead;

using the digital controller for determining a media position of a sheet of media when loaded on the drum, the determined media position associated with the second axis; and storing in a computer readable memory values indicative of the results of said determining steps for use in automatically registering a sheet of media to be loaded on the drum.

12. The method of claim 11, further comprising:

determining using the first sensor a media position of a subsequent sheet of media when loaded on the drum, the determined media position associated with the first axis; and adjusting a printhead ejection time based on the determined media position of the subsequent sheet of media and the determined first relative distance.

13. The method of claim 11, wherein the step of determining a first relative distance between a first sensor and a printhead of the carriage comprises measuring the distance between the second sensor and the printhead; measuring the distance between the first sensor and the second sensor; and taking the difference between said two measured distances.

14. The method of claim 13, wherein the step of measuring the distance between the first sensor and the second sensor further comprises positioning the second sensor at the same vertical position as the first sensor and advancing a sheet of media about said drum to cause said first and second sensors to detect said advancing media at different positions; the difference in said different positions corresponding to the distance between said first and second sensors.

15. The method of claim 11, wherein the step of determining a second relative distance between a second sensor movable along the second axis and the printhead comprises loading a sheet on said drum; printing a pattern on the sheet associated with a given position; positioning the second sensor using the carriage and slewing the carriage to cause said second sensor to detect the printed pattern on the sheet at another position; and calculating the distance between said given position and said another position.

16. The method of claim 11, wherein the determining a first relative distance between the first sensor and the printhead comprises:

advancing a sheet of media on the drum;

positioning the second movable sensor associated with the carriage in a position parallel to the first sensor.

17. A method of controlling triggering of printheads for printing onto a media sheet when the media sheet is loaded on a drum, comprising:

using a digital controller for advancing each the media sheet from a staging location to the drum such that a leading edge of each advancing media sheet is expected to engage the drum at a loading location and corresponding to a given printhead firing position;

using the digital controller for detecting a leading edge of the advancing media sheet loading on the drum;

using the digital controller for determining a position of loading the media sheet onto the drum based on said leading edge detecting;

using the digital controller for adjusting the trigger time of the printhead based on the determined position and a stored value corresponding to a predefined calculated distance between a first sensor and the printhead.

* * * * *

UNITED STATES PATENT AND TRADEMARK OFFICE

CERTIFICATE OF CORRECTION

PATENT NO. : 7,703,873 B2
APPLICATION NO. : 11/724948
DATED : April 27, 2010
INVENTOR(S) : Hsue-Yang Liu et al.

It is certified that error appears in the above-identified patent and that said Letters Patent is hereby corrected as shown below:

In column 10, line 38, in Claim 17, after "each" insert -- of --.

Signed and Sealed this

Thirty-first Day of August, 2010

David J. Kappos

David J. Kappos
*Director of the United States Patent and Trademark Office*